US009806463B2

(12) United States Patent
Joo et al.

(10) Patent No.: US 9,806,463 B2
(45) Date of Patent: Oct. 31, 2017

(54) GROUNDING TYPE ELBOW CONNECTOR HAVING ELECTROSCOPE THEREIN

(71) Applicant: PYUNGIL CO., LTD., Gyeonggi-do (KR)

(72) Inventors: Jong Min Joo, Gyeonggi-do (KR); Sea Jun Lee, Gyeonggi-do (KR); Chung Mo Je, Gyeonggi-do (KR); Kyoung Sun Choi, Seoul (KR); Jin Sub An, Seoul (KR); Seung Hong Lee, Seoul (KR)

(73) Assignee: PYUNGIL CO., LTD., Gyeonggi-do (KR)

( * ) Notice: Subject to any disclaimer, the term of this patent is extended or adjusted under 35 U.S.C. 154(b) by 0 days.

(21) Appl. No.: 15/028,144

(22) PCT Filed: Jun. 9, 2014

(86) PCT No.: PCT/KR2014/005046
§ 371 (c)(1),
(2) Date: Apr. 8, 2016

(87) PCT Pub. No.: WO2015/174572
PCT Pub. Date: Nov. 19, 2015

(65) Prior Publication Data

US 2017/0070005 A1 Mar. 9, 2017

(30) Foreign Application Priority Data

May 16, 2014 (KR) ..... 10-2014-0058939

(51) Int. Cl.
*H01R 3/00* (2006.01)
*H01R 13/641* (2006.01)
*H01R 9/05* (2006.01)
*H01R 13/66* (2006.01)

(52) U.S. Cl.
CPC ..... *H01R 13/641* (2013.01); *H01R 9/05* (2013.01); *H01R 13/6675* (2013.01); *H01R 13/6683* (2013.01)

(58) Field of Classification Search
CPC .... H01R 13/641; H01R 9/05; H01R 13/6675; H01R 13/6683
USPC ..... 439/181, 186, 187, 490, 921
See application file for complete search history.

(56) References Cited

U.S. PATENT DOCUMENTS 7,695,291 B2 * 4/2010 Hughes ..... G01R 31/07 439/181
8,408,925 B2 * 4/2013 Borgstrom ..... H01R 3/00 439/181

FOREIGN PATENT DOCUMENTS

| | | |
|---|---|---|
| JP | 2004-072850 | 3/2004 |
| KR | 1020080024646 | 3/2008 |
| KR | 101066526 | 9/2011 |
| KR | 1020130139670 | 12/2013 |

(Continued)

*Primary Examiner* — Khiem Nguyen
(74) *Attorney, Agent, or Firm* — IP & T Group LLP

(57) ABSTRACT

A ground type elbow connector includes an elbow housing 100, and an electroscope 200 that is assembled onto the elbow housing to allow both a visual check on an activated state of a power cable and a grounding operation to occur. The elbow housing is connected to an insulation plug of an elbow connection unit for a power cable that is assembled onto a voltage detection part opposite to a bushing coupling part via which the elbow connection unit is connected with a bushing insert of a switch.

9 Claims, 7 Drawing Sheets

(56) References Cited

FOREIGN PATENT DOCUMENTS

| | | |
|---|---|---|
| KR | 101368384 | 3/2014 |

* cited by examiner

[FIG. 1]
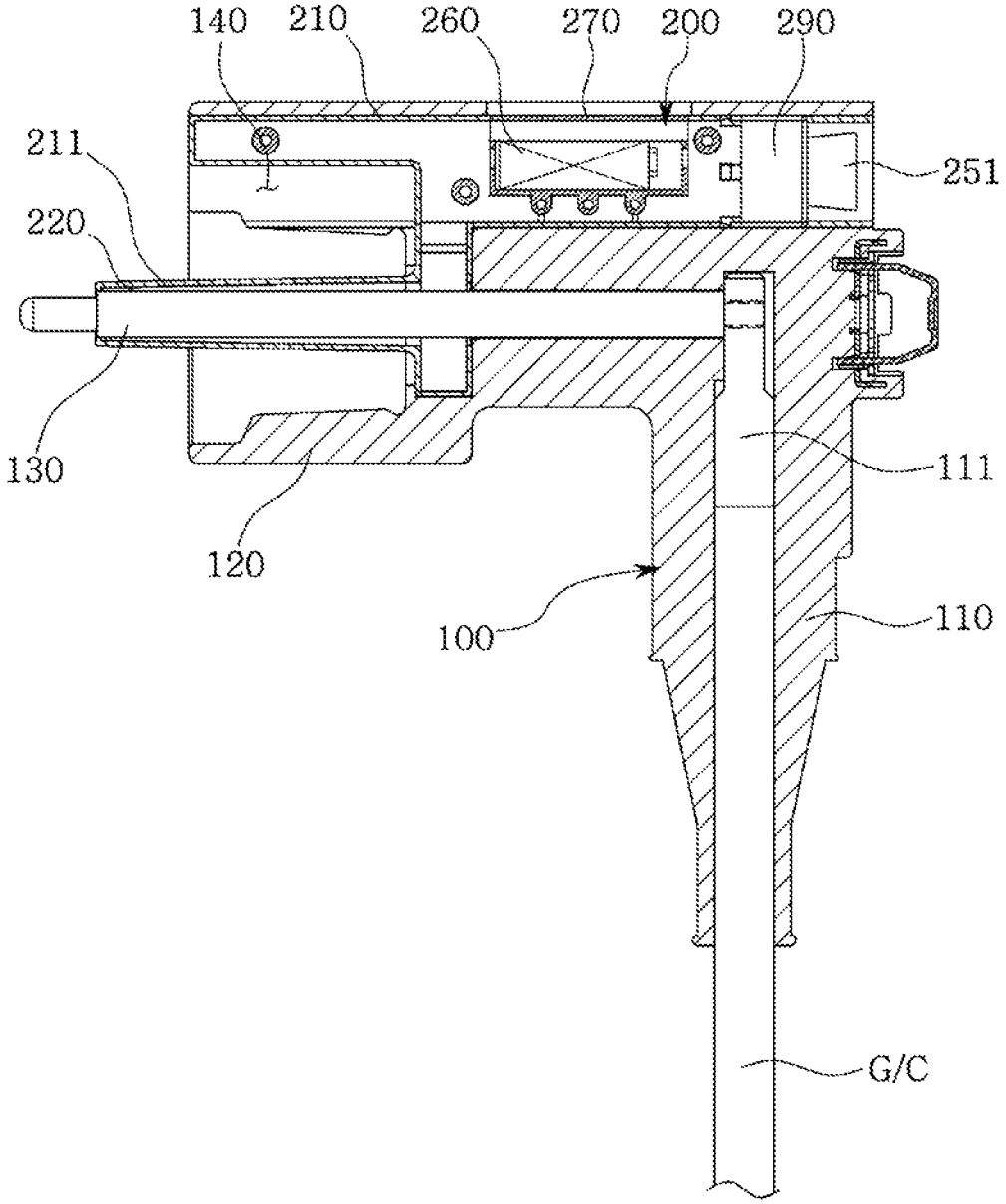

[FIG. 2]
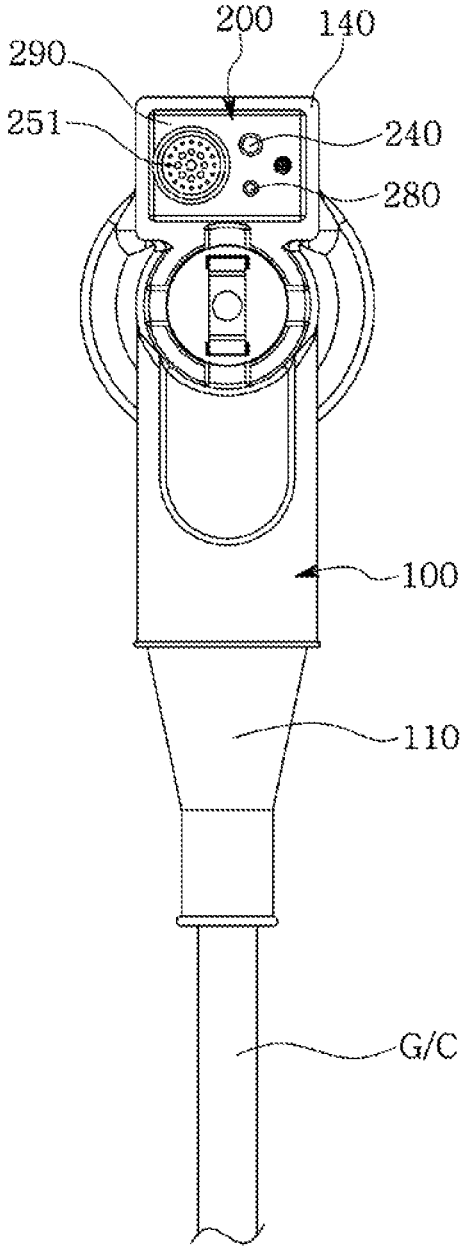

[FIG. 3]
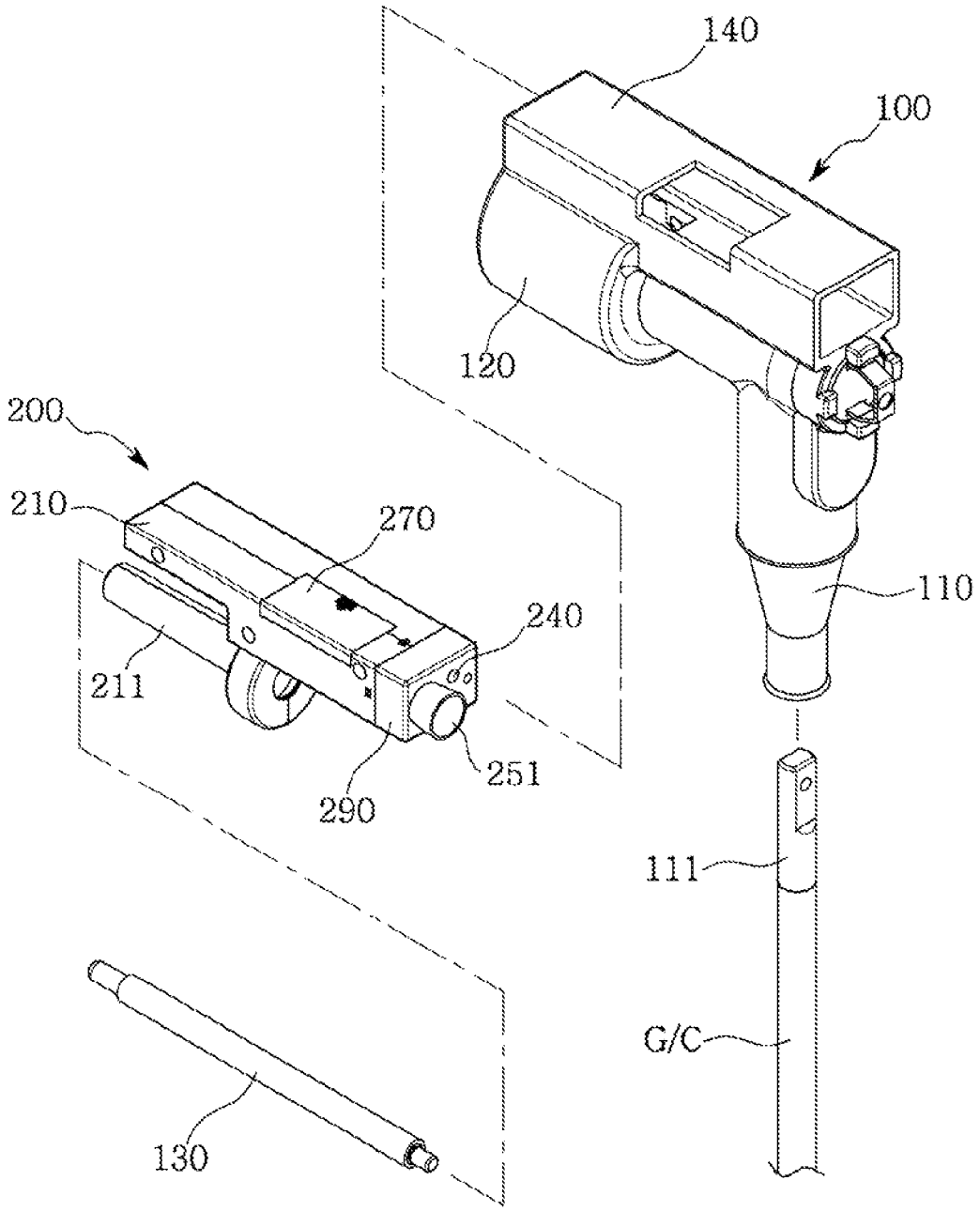

[FIG. 4]
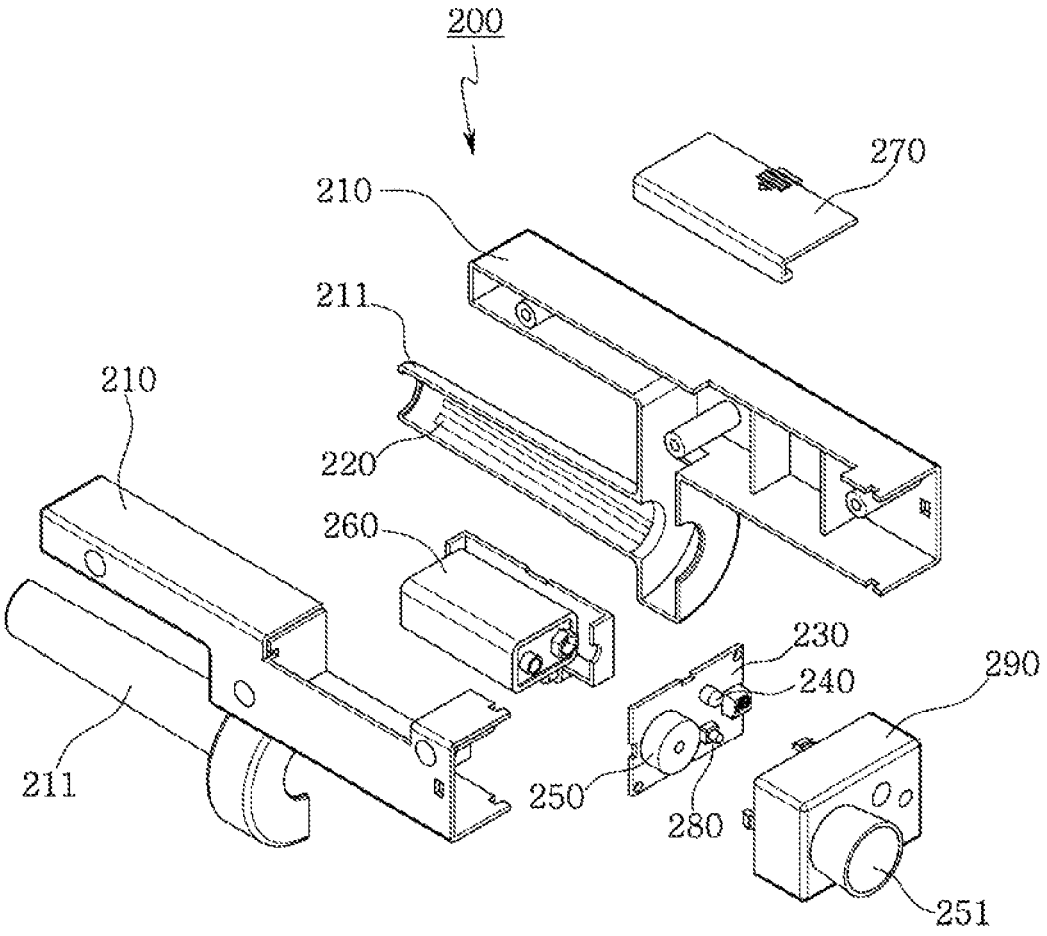

[FIG. 5]
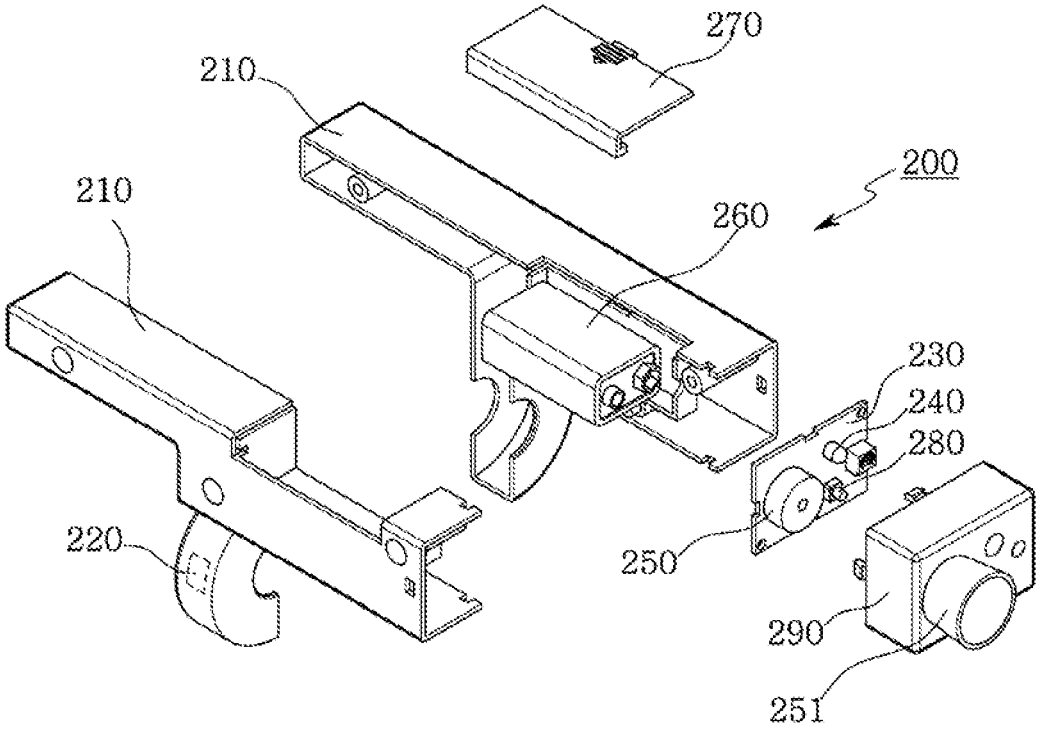

[FIG. 6]
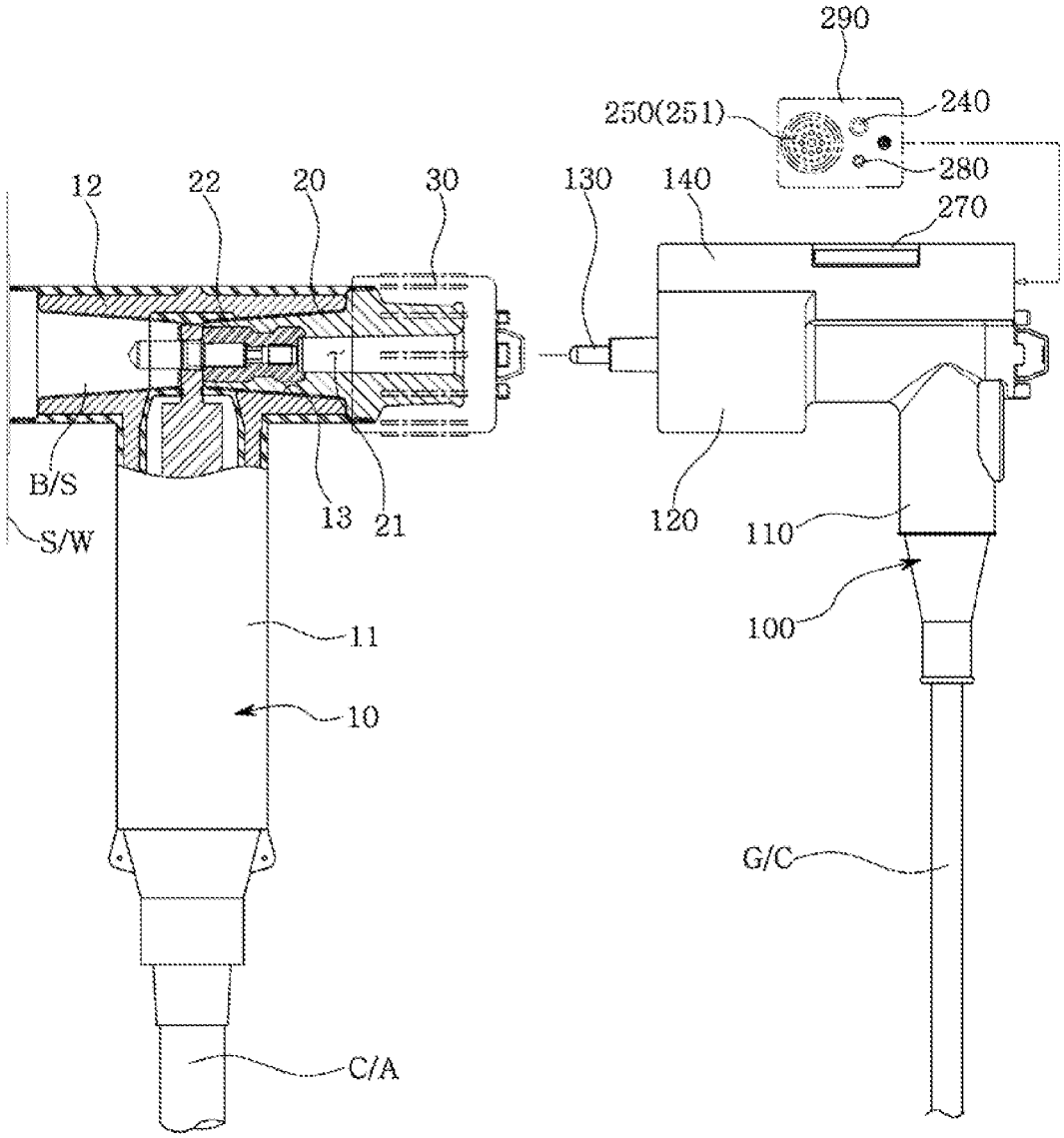

[FIG. 7]
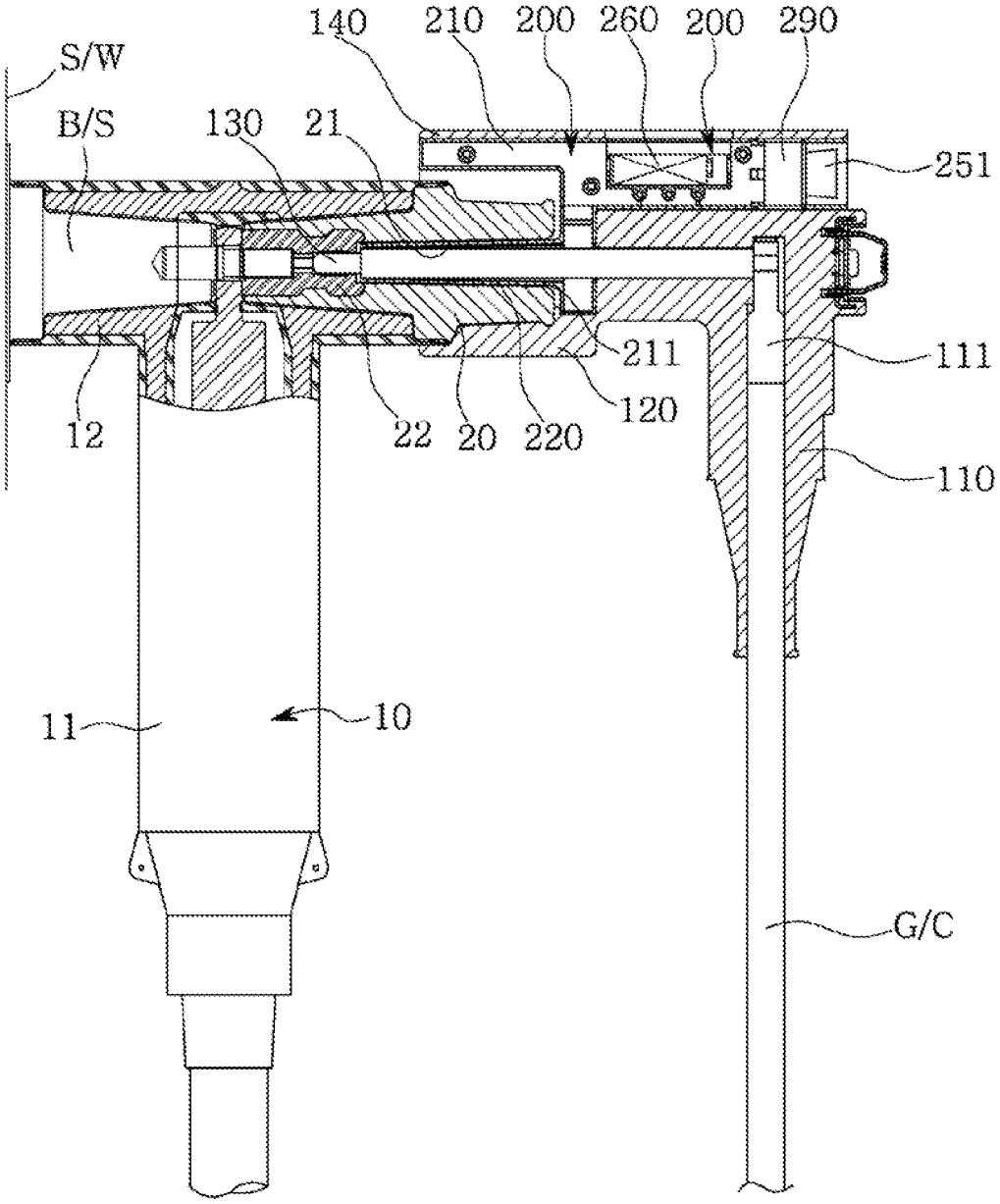

GROUNDING TYPE ELBOW CONNECTOR HAVING ELECTROSCOPE THEREIN

This application is a national stage application of PCT/KR2014/005046 filed on Jun. 9, 2014, which claims priority of Korean patent application number 10-2014-0058939 filed on May 16, 2014. The disclosure of each of the foregoing applications is incorporated herein by reference in its entirety.

TECHNICAL FIELD

The present invention relates generally to a ground type elbow connector having a grounding connection structure to allow a power cable, which is connected to a bushing of a switch by an elbow connection unit, to be grounded by the elbow connector itself. More particularly, the present invention relates to a ground type elbow connector having an electroscope therein, in which replacement or maintenance of a switch can be safely provided in case of discharge of a current that is charged, in the switch at the same time as a grounding operation through a connection in a state where a grounded state of a power cable is stably and rapidly identified through the embedded electroscope.

BACKGROUND ART

A conventional elbow connector for a power cable has been widely disclosed and is well known as a medium connector that facilitates the connection between a power cable and a high-voltage device such as a switch or the like in a padmount.

Such an elbow connector is connected to or disconnected from, for example, a bushing insert attached to a bushing well of a switch so as to be connected to the switch via a cable.

That is, the elbow connector has a first terminal side that is provided to accommodate a power cable, and a second terminal side that is provided to accommodate an insertion end of the bushing insert.

Further, the elbow connector also has another terminal side that is provided opposite to the second terminal side to receive an insulation plug and an insulation cap, thereby forming a T-type structure along with the first and second terminal sides.

An exemplary elbow connector is disclosed in Patent Document 1.

That is, the elbow connector of Patent Document 1 includes an insulating housing that has a multi-layer structure, in which an internal insulating layer formed of a rubber-like insulating material is internally and externally surrounded by a semi-conductive protection layer formed of a rubber-like elastomer, such that a cable receiving part in a vertical direction and a bushing connection part and a voltage detection part in a horizontal direction are formed in a horizontally symmetric manner.

The elbow connector also includes a conductor that is assembled in a state of protruding in the central portion of the bushing connection part and the voltage detection part while forcedly engaging wires of a high voltage cable through an internal space of the cable receiving part and to which a stud bolt screwed onto a bushing insert attached to a switch is assembled.

Further, the elbow connector includes an insulation plug in which a fastening nut and a test point, which are screwed onto a rear end of the stud bolt, are insert-molded onto front and rear ends of an insulating material so as to be coupled to the voltage detection part, and an insulation cap that covers the test point exposed to a rear end of the insulation plug.

The cable includes an adapter assembled onto an insulation cladding in order to prevent shaking in the cable receiving part and to facilitate sealed assembly.

The elbow connector of Patent Document 1 (Korean Unexamined Patent Publication No. 10-2008-0024646 published on Mar. 19, 2008) has a function of detecting a voltage using the test point of the insulation plug so as to check an activated state of a distribution line or detecting a phase of power source side and load side and checking an open phase state thereof.

In order to eliminate the drawbacks of Patent Document 1 wherein the protruded length of the voltage detection part side is increased, a technique is disclosed in Patent Document 2 (Korean Patent Registration No. 10-1066526, registered on Sep. 15, 2011), in which an asymmetric structure is formed such that a length of the voltage detection part is made smaller than a bushing connection part, and a manipulation ring of the insulation cap is made into a folded type, thereby reducing the protruded length of the voltage detection part to the max.

Although Patent Documents 1 and 2 have a function of checking an activated state of a distribution line or detecting a phase of power source side and load side and checking an open phase state thereof, configurations of Patent Documents have a problem in that, when a cable is intended to be grounded as necessary, the configurations should have a switch having a separate ground switch therein. Further, in the case of a conventional elbow connector having no grounding function, it is first disconnected from a switch and then a separate grounding elbow connector is connected to the switch so as to check a voltage and ground itself, leading to troublesome, complex work and providing inconvenience and limitations in use.

In other words, a conventional elbow connector has drawbacks in that, since it has no grounding function, upon replacement of a cable in a switch or line working, a switch having a separate grounding switch therein should be employed, or a separate grounding connector should be connected thereto so as to check a voltage and ground itself, leading to complex replacement of a cable, increased sire of the switch, and limited range in use.

To solve these problems, the applicant proposed a ground type elbow connector disclosed in Patent Document 3 (Korean patent Registration No. 10-1368384, registered on Feb. 21, 2014) that has a grounding connection structure to allow a power cable to be grounded by the elbow connector itself and in which safe replacement or maintenance of a switch is ensured by safely checking a grounded state of a power cable using a ground inspection connection device.

The elbow connector of Patent Document 3 is separately provided with the ground inspection connection device that has a function of detecting an electric charge.

Thus, Patent Document 3 has the same problem as those of Patent Documents 1 and 2, in that, although a grounding operation is instantly performed, the ground inspection connection device having a function of detecting an electric charge is separately provided, resulting in an unreliable, unstable connection of the ground inspection connection device, which may possibly cause a safety accident or malfunction.

Furthermore, there have also been other problems such as separate storage, inconvenient portability in use, sensor damage due to careless handling, or the like of the ground inspection connection device.

DISCLOSURE

Technical Problem

Accordingly, the present invention has been, made keeping in mind me above problems occurring in the related art, and an object of the present invention is to provide a ground type elbow connector integrally having an electroscope therein, by which replacement or maintenance of a switch can be safely provided, along with a quick ground connection and a quick, safe check of a grounded state.

Another object of the present invention is to provide a ground type elbow connector that, when connected to a switch, allows an operator to do his/her work while checking a speaker, an activation display LED, an alarm sound from an operation button, visual identification or the like, thereby providing improved reliability and convenience in use.

Technical Solution

In order to accomplish the above objects, the present invention provides a around type elbow connector including: an elbow housing; and an electroscope that is assembled onto the elbow housing to allow both a visual check on an activated state of a power cable and a grounding operation to occur, wherein the elbow housing is connected to an insulation plug of an elbow connection unit for a power cable that is assembled onto a voltage detection part opposite to a bushing coupling part via which the elbow connection unit is connected with a bushing insert of a switch.

Further, the present invention provides a ground type elbow connector including:

an elbow housing; and an electroscope, wherein the elbow housing includes: a vertical cable assembly part in which a connection conductor is provided to connect a ground cable; a horizontal coupling part serving to accommodate and couple one circumferential side of an insulation plug while internally holding a connection probe, which extends from the coupling part to a conductor part through a through hole of the insulation plug such that a leading end thereof is to be connected with the conductor part by a stud bolt and a rear end thereof is screwed onto the connection conductor; and an electroscope cover part that is provided on an upper portion of the coupling part, wherein the electroscope is installed in the electroscope cover part, and serves to sense the connection probe to be connected with the conductor part of the insulation plug to visually check an activated state of a switch.

The electroscope may include: a housing section formed with plastic and provided with an antenna part having a sensor that is closely assembled in the through hole of the insulation plug while accommodating the connection probe therein so as to sense an activated state of the switch with the sensor; an internal circuit board accommodated in the housing section and electrically connected with an LED lamp and a buzzer that are exposed to the outside of the housing section so as to indicate the activated state, which is obtained by calculating a sensing signal from the sensor of the antenna part, via optical and acoustic signatures, respectively; and a battery supplying electric power to the internal circuit board.

A test button may be provided to the outside of the housing section, such that the test button is electrically connected with the internal circuit board so as to check an operation of the battery.

The housing section may be formed into two that will be easily fastened each other by screws, and wherein the internal circuit board and the battery may be accommodated between the two cases, which define an upper opening, to which a battery cover is assembled to open and close for replacement of the battery.

A display case may be provided such that the display case is connected with the two cases of the housing section, wherein the display case is provided with an echo speaker to diffuse an echo sound, and the LED lamp and the test button are exposed to the outside through the display case.

Advantageous Effects

According to the present invention, the ground type elbow connector can be simply grounded in an activated state of a switch, and enables replacement of failed or possibly-failed components of equipment through a quick, safe visual check of a grounded state, thereby providing an effect of improving field workability and of, since, unlike a conventional elbow connector, there is no need to have a separate grounding switch unit in a switch, removing failure factors of the switch and thus extending a lifetime thereof.

Further, according to the present invention, the electroscope allowing a visual check of a grounded state with a simple operation is integrally provided in the ground type elbow connector, so that inconvenience occurring due to problems of storage and portability of the electroscope is eliminated, and, when connected, the electroscope provides a visual, audible check of a safe ground, facilitating a simple replacement or check of a switch.

Further, according to the present invention, a ground is instantly obtained by direct connection of a ground type elbow connector to an insulation plug of an elbow connection unit for a power cable, thereby ensuring quick, convenient a grounding operation.

Further, according to the present invention, the electroscope capable of detecting an electric charge is integrally provided in a prefabricated form in the ground type elbow connector thereby to form a compact structure, allowing industrial mass production into light products that are easy to store and transport.

DESCRIPTION OF DRAWINGS

FIG. 1 is a cross-sectional view of a ground type elbow connector having an electroscope therein according to an embodiment of the present invention;

FIG. 2 is a rear view of the ground type elbow connector having the electroscope;

FIG. 3 is an exploded perspective view of the ground type elbow connector in which the electroscope is disassembled from an elbow housing;

FIG. 4 is an exploded perspective view of the electroscope as a major component of the ground type elbow connector;

FIG. 5 is an exploded perspective view of another embodiment of the electroscope as a major component of the ground type elbow connector; and FIGS. 6 and 7 are views showing sequential connection of the ground type elbow connector to an elbow connection unit for a power cable connected to a switch.

BEST MODE

The present invention is directed to a ground type elbow connector having an electroscope therein, in which replacement or maintenance of a switch can be safely provided in case of discharge of a current that is charged in the switch at the same time as a grounding operation through a connection in a state where a grounded state of a power cable is stably and rapidly identified through the embedded electroscope.

Hereinbelow, the present invention will be described in detail with reference to the accompanying drawings.

FIG. 1 is a cross-sectional view of a ground type elbow connector having an electroscope therein according to an embodiment of the present invention. FIG. 2 is a rear view of the ground type elbow connector having the electroscope, and FIG. 3 is an exploded perspective view of the ground type elbow connector in which the electroscope is disassembled from an elbow housing.

Referring to these drawings, the ground type elbow connector serves as a grounding unit that, when maintenance or replacement is performed on ground or underground equipment, such as a transformer, a high-voltage switch (S/W) or the like, is connected directly to an elbow connection unit 10 for a power cable, which has been connected to the equipment, as shown in FIGS. 6 and 7, so as to provide a ground thereto.

That is, the ground type elbow connector includes an elbow housing 100 and an electroscope 200 that is assembled onto the elbow housing 100 to allow both a visual check on an activated state of a power cable (C/A) and a grounding operation to occur. The elbow housing is connected to an insulation plug 20 of an elbow connection unit for a power cable (C/A) that is assembled onto a voltage detection part 13 opposite to a bushing coupling part 12 via which the elbow connection unit is connected with a bushing insert (B/S) of a switch (S/W) with the power cable (C/B) connected by a cable assembly 11.

A detailed configuration of the ground type elbow connector will be described as follows.

The elbow housing 100 includes a vertical cable assembly part 110 in which a connection conductor 111 is provided to connect a ground cable (G/C), a horizontal coupling part 120 serving to accommodate and couple one circumferential side of the insulation plug 20 while internally holding a connection probe 130, which extends from the coupling part 120 to a conductor part 22 through a through hole 21 of the insulation plug 20 such that a leading end thereof is to be connected with the conductor part 22 by a stud bolt and a rear end thereof is screwed onto the connection conductor 111, and an electroscope cover part 140 that is provided on an upper portion of the coupling part 120.

The electroscope 200 is installed in the electroscope cover part 140, and serves to sense the connection probe 130 to be connected with the conductor part 22 of the insulation plug 20 to visually check an activated state of the switch (S/W).

As shown in FIG. 4, the electroscope 200 includes a housing section 210, a sensor 220, an internal circuit board 230, an LED lamp 240, a buzzer 150, and a battery 260.

The housing section 210 is formed with plastic into two half cases that will be easily fastened to each other by screws.

The internal circuit board 230 and the battery 260 are accommodated between the two cases, which define an upper opening, to which a battery cover 270 is assembled to open and close for replacement of the battery 260.

The housing section 210 is provided with an antenna part 211 having a sensor 220 that is closely assembled in the through hole 21 of the insulation plug 20 while accommodating the connection probe 130 therein so as to sense an activated state of the connection probe with the sensor 220.

The sensor 220 may be a proximity sensor that is electrically connected with the internal circuit board 230.

The internal circuit board 230 is electrically connected with the battery 260 accommodated in the housing section 210, and the battery can be replaced with new one through the battery cover 270.

The internal circuit board 230 is electrically connected with the LED lamp 240 and the buzzer 250 that are exposed to the outside so as to indicate the activated state, which is obtained by calculating a sensing signal from the sensor 220, via optical and acoustic signatures, respectively.

A test button 280 is provided to the outside of the housing section 210, such that the test button is electrically connected with the internal circuit board 230 so as to check an operation (discharged state) of the battery 260.

A display case 290 is also provided such that it is connected with the two cases of the housing section 210. Here, the display case is provided with an echo speaker 251 to diffuse an echo sound, and the LED lamp 240 and the test button 280 are exposed to the outside through the display case.

The connection of the ground type elbow connector will be described with reference to FIGS. 6 and 7.

First, a discharged state of the battery 260 is preferably checked prior to use of the electroscope, since the electroscope 200 plays an important role in the present invention.

That is, when the test button 280 is pushed, if the LED lamp 240 switches on and the buzzer makes a buzzing sound, it is determined that the battery 260 is in a normal state that is not a discharged state. Further, if the LED lamp 240 does not switch on and the buzzer does not make a buzzing sound, it is determined that the battery 260 is in a discharged state, so the battery is replaced with new one.

After it is determined that the battery 260 is in an available state, an insulation cap 30 is disassembled from the insulation plug 20, which is assembled to the voltage detection part 13 of the elbow connection unit 10 for a power cable connected with a transformer or a switch (S/W), using a hot-stick.

After the insulation cap 30 is disassembled, for the connection to the elbow connection unit, the coupling part 120 of the ground type elbow connector 100 is manipulated to move towards the insulation plug 20.

In this process, as the coupling part 120 comes close to the insulation plug, a leading end of the connection probe 130 first reaches the insulation plug, so that, if the switch (S/W) is in a power-on state, the sensor 220 senses it so the busier 250 is activated to generate an alarm sound through the echo speaker 251 of the display case 290.

Therefore, an operator can do his/her work in a grounded state that is obtained by the connection of the elbow connector in a state of the switch (S/W) being turned off.

In this state, even when the coupling part 120 of the ground type elbow connector 100 is connected to the insulation plug 20 so that the connection probe 130 contacts the conductor part 22 in the insulation plug 20 that has been connected to the switch (S/W), the sensor does not sense a voltage of the conductor part 22, resulting in the buzzer 250 generating no alarming sound.

As shown in FIG. 7, with the above-mentioned process, the complete connection of the ground type elbow connector, i.e. the connection of the insulation plug 20 by the coupling part 120 of the ground type elbow connector 100 along with the connection of the connection probe 130 with the conductor part 22 of the insulation plug 20 through the through hole 21 of the insulation plug 20 by a stud bolt is obtained.

Such a connection facilitates safe replacement or maintenance of a distribution line with the discharge of a charged current in a switch (S/W).

As described before, according to the present invention, when the sensor 220 senses that a switch (S/W) to be replaced or repaired is in an activated state, a buzzer 250 generates an alarm sound. Further, when the sensor 220 senses that the switch is in an inactivated state, the buzzer does not generate an alarm sound. At this time, the connection probe 130 is inserted into the through hole 21 of the insulation plug 20 in the elbow connection unit 10 connected to the switch (S/W) so that a charged current of the switch (S/W) is discharged, allowing safe replacement or maintenance of the switch (S/W). This is a key feature of the present invention.

In other words, according to the present invention, a switch (S/W) can be safely replaced or repaired in a state where a grounded state of the switch has been safely checked, thereby ensuring a safe, quick, and convenient operation.

As set forth in the foregoing, the present invention has been described with reference to the embodiments. However, the present invention is not limited thereto, and may be diversely modified without departing from the technical scope of the present invention.

For example, the antenna part 211 having the sensor 220 therein may be provided on one side of the housing section 210, rather than being provided to protrude from the housing section 210 as shown in FIG. 5.

Further, a material of the housing section 210 is not limited to that described in the former embodiment.

Although the preferred embodiments of the present invention have been disclosed in the detailed description, it is possible to make various modifications without departing from the scope of the invention. Therefore, the scope of the invention should not be limited to the above-mentioned embodiments, but may be defined by the accompanying claims and equivalents thereof.

INDUSTRIAL APPLICABILITY

The present invention is very conveniently and usefully applicable to various industrial applications in that, when a ground is required during replacement or maintenance of a switch, the ground type elbow connector can be instantly and safely used by the connection to a connection unit connected with the switch.

The invention claimed is:

1. A ground type elbow connector comprising:

an elbow housing including:

a vertical cable assembly part in which a connection conductor is provided to connect a ground cable;

a horizontal coupling part to accommodate and couple one circumferential side of an insulation plug while internally holding a connection probe that extends from the horizontal coupling part to a conductor part of the insulation plug through a through hole in the insulation plug such that a leading end of the connection probe is to be connected with the conductor part and a rear end of the connection probe is to be screwed onto the connection conductor; and an electroscope cover part that is provided on an upper portion of the horizontal coupling part, and an electroscope installed in the electroscope cover part to sense a connection of the connection probe to the conductor part of the insulation plug to provide a visual indication of whether or not the connection probe is activated.

2. The ground type elbow connector of claim 1, wherein the electroscope includes:

an antenna connected to a sensor located in the through hole of the insulation plug to sense an activation state of the connection probe;

an internal circuit board to receive a signal from the sensor and identify an activation state of the connection probe based on the signal;

an LED lamp connected to the internal circuit board to indicate the activation state of the connection probe via an optical signature;

a buzzer connected to the internal circuit board to indicate the activation state of the connection probe via an acoustic signature; and a battery supplying electric power to the internal circuit board, wherein the internal circuit board, the LED lamp, the buzzer, and the battery are provided in a housing section that allows transmission of the optical signature and the acoustic signature to the outside of the housing section.

3. The ground type elbow connector of claim 2, further comprising:

a test button located in an outside surface of the housing section, the test button being electrically connected with the internal circuit board, wherein the internal circuit board checks and displays a discharge state of the battery when the test button is pushed.

4. The ground type elbow connector of claim 2, wherein the housing section further comprises:

a first half case and a second half case joined to each other to form the housing section, wherein the housing section defines an upper opening to receive the battery; and a battery cover to removably engage the housing section to open and close the upper opening.

5. The ground type elbow connector of claim 2, further comprising:

a display case connected with the housing section, the display case having speaker to transmit the acoustic signal from the buzzer, and openings to receive and expose the LED lamp and the test button.

6. The ground type elbow connector of claim 1, wherein the electroscope includes:

a sensor sensing an activated state of the connection probe;

an internal circuit board to receive a signal from the sensor and identify an activation state of the connection probe based on the signal;

an LED lamp connected to the internal circuit board to indicate the activation state of the connection probe via an optical signature;

a buzzer connected to the internal circuit board to indicate the activation state of the connection probe via an acoustic signature; and a battery supplying electric power to the internal circuit board, wherein the internal circuit board, the LED lamp, the buzzer, and the battery are provided in a housing section that allows transmission of the optical signature and the acoustic signature to the outside of the housing section.

7. The ground type elbow connector of claim 6, further comprising:

a test button located in an outside surface of the housing section, such that the test button being electrically connected with the internal circuit board, wherein the internal circuit board checks and displays a discharge state of the battery when the test button is pushed.

8. The ground type elbow connector of claim 6, wherein the housing section further comprises:

a first half case and a second half case joined to each other to form the housing section, wherein the housing section defines an upper opening to receive the battery, and a battery cover to removably engage the housing section to open and close the upper opening.

9. The ground type elbow connector of claim 6, further comprising:

a display case connected with the housing section, the display case having a speaker to transmit the acoustic signal from the buzzer, and openings to receive and expose the LED lamp and the test button.

* * * * *